US006055805A

United States Patent [19]

El-Aini et al.

[11] Patent Number: 6,055,805

[45] Date of Patent: May 2, 2000

[54] ACTIVE ROTOR STAGE VIBRATION CONTROL

[75] Inventors: Yehia M. El-Aini, Jupiter; Barry K. Benedict, West Palm Beach; Samy Baghdadi, Palm Beach Gardens; A. Paul Matheny, Jupiter, all of Fla.

[73] Assignee: United Technologies Corporation, Hartford, Conn.

[21] Appl. No.: 08/920,493

[22] Filed: Aug. 29, 1997

[51] Int. Cl.[7] ..... F02C 7/00

[52] U.S. Cl. ..... 60/226.1; 60/262; 415/117; 415/119

[58] Field of Search ..... 60/226.1, 262, 60/725; 415/115, 116, 117, 119, 178

[56] References Cited

U.S. PATENT DOCUMENTS 3,628,880 12/1971 Smuland et al. ..... 415/115
4,255,083 3/1981 Andre et al. ..... 415/119
4,497,610 2/1985 Richardson et al. ..... 415/116
5,584,651 12/1996 Pietraszkiewicz et al. ..... 415/115

*Primary Examiner*—Louis J. Casaregola
*Attorney, Agent, or Firm*—Richard D. Getz

[57] ABSTRACT

An apparatus for controlling vibrations in a rotor stage rotating through core gas flow is provided. The apparatus includes a source of high-pressure gas and a plurality of ports for dispensing high-pressure gas. The rotor stage rotates through core gas flow having a plurality of circumferentially distributed first and second regions. Core gas flow within each first and second region travels at a first and a second velocity, respectively. The first velocity is substantially higher than the second velocity. The ports dispensing the high-pressure gas are selectively positioned upstream of the rotor blades, and aligned with the second regions such that high-pressure gas exiting the ports enters the second regions. The velocity of core gas flow in the second regions consequently increases, and substantially decreases the difference in core gas flow velocity between the first and second regions.

17 Claims, 4 Drawing Sheets

ACTIVE ROTOR STAGE VIBRATION CONTROL

BACKGROUND OF THE INVENTION

1. Technical Field

This invention relates to gas turbine engine rotor assemblies in general, and to apparatus for controlling vibrations in rotor stages in particular.

2. Background Information

The fan, compressor, and turbine sections of a gas turbine engine typically include a plurality of stator vane and rotor stages. The stator vane stages direct air flow (referred to hereafter as "core gas flow") in a direction favorable to downstream rotor stages. Each stator vane stage includes a plurality of stator vanes extending radially between inner and outer static radial platforms. Each rotor stage includes a plurality of rotor blades extending radially out from a rotatable disk. Depending upon where the rotor stage is within the engine, the rotor stage either extracts energy from, or adds energy to, the core gas flow. The velocity of the core gas flow passing through the engine increases with the rotational velocity of the rotors within the system. A velocity curve depicting core gas flow velocities immediately downstream of a stator vane stage reflects high velocity regions disposed downstream of, and aligned with the passages between stator vanes, and low velocity regions disposed downstream of, and aligned with each stator vane. The disparity between the high and low velocity regions increases as the velocity of the core gas flow increases. The high and low velocity regions have a significant effect on rotor blades passing through the region immediately downstream of the stator vanes.

Rotor blades typically have an aerodynamic cross-section that enable them to act as a "lifting body". The term "lifting body" refers to a normal force applied to the airfoil by air traveling past the airfoil, from leading edge to trailing edge, that "lifts" the airfoil. The normal force is a function of: (1) the velocity of the gas passing by the airfoil; (2) the "angle of attack" of the airfoil relative to the direction of the gas flow; and (3) the surface area of the airfoil. The normal force is usually mathematically described as the integral of the pressure difference over the length of the airfoil. The difference in gas flow velocity exiting the stator vane stage creates differences in the normal force acting on the rotor blade.

The changes in normal force caused by the different velocity regions are significant because of the vibration they introduce into the rotor blades individually, and the rotor stage collectively. Low velocity regions can be described as producing a normal force on each rotor blade equal to "F", and high velocity regions described as producing a normal force on each blade "F+ΔF", where ΔF represents an additional amount of normal force. A blade rotating through the regions of low and high velocity gas flow will, therefore, experience periodic pulsations of increased force "ΔF" (also referred to as a periodic excitation force). The frequency of the periodic excitation force is a function of the rotational speed of the rotor, since the number of stator vanes that create the low velocity regions is a constant. The magnitude of "ΔF" depends upon the velocity of the core gas flow.

Vibrations in a rotor stage are never desirable, particularly when the frequency of the excitation force coincides with a natural frequency of the rotor stage; i.e., resonance. In most cases, resonance can be avoided by "tuning" the natural frequencies of the rotor stage outside the frequency of the excitation force by stiffening, adding mass, or the like.

Alternatively, damping can be used to minimize the resonant response of the rotor stage. It is not always possible, however, to "tune" the natural frequencies of a rotor stage to avoid undesirable resonant responses. Nor is it always possible to effectively damp vibrations within a rotor stage. It would be a great advantage, therefore, to minimize or eliminate the cause of the vibration (i.e., the excitation force), rather than adapt the rotor stage to accommodate the vibration.

DISCLOSURE OF THE INVENTION

It is, therefore, an object of the present invention to provide an apparatus and method for minimizing or eliminating rotor blade vibrations.

It is another object of the present invention to provide an apparatus and method for minimizing or eliminating rotor blade vibrations that minimizes or eliminates the cause of the vibration.

According to the present invention, an apparatus for controlling vibrations in a rotor stage rotating through core gas flow is provided. The apparatus includes a source of high-pressure gas and a plurality of ports for dispensing high-pressure gas. The rotor stage rotates through core gas flow having a plurality of circumferentially distributed first and second regions. Core gas flow within each first and second region travels at a first and a second velocity, respectively. The first velocity is substantially higher than the second velocity. The ports dispensing the high-pressure gas are selectively positioned upstream of the rotor blades, and aligned with the second regions such that high-pressure gas exiting the ports enters the second regions. The velocity of core gas flow in the second regions consequently increases, and substantially decreases the difference in core gas flow velocity between the first and second regions.

An advantage of the present invention is that the cause of problematic vibrations is addressed rather than resultant undesirable vibration. Rotor stages are often "tuned" to avoid undesirable resonant responses by stiffening the rotor stage or adding mass to the rotor stage. Adding mass to a blade undesirably increases the overall mass of the rotor stage and can increase stresses in the rotor disk. Rotor stages can also be damped to minimize an undesirable resonant response. Damping features almost always add to the cost of the blades, increase the blade maintenance requirements, and can limit the life of a blade. The present invention, in contrast, minimizes or eliminates forcing functions that cause vibration, and thereby eliminates the need to "tune" or damp a rotor stage.

Another advantage of the present invention is that it can be used to minimize or eliminate problematic vibrations in integrally bladed rotors (IBR's). In many cases, it is exceedingly difficult to tune an IBR or provide adequate damping due to the one piece geometric configuration of the rotor. For example, the blades of the IBR often cannot be machined individually to receive damping means. The present invention overcomes the damping limitations of IBR's by eliminating the need to alter the rotor blades of the IBR.

BEST MODE FOR CARRYING OUT THE INVENTION

I. Apparatus

Figure 1:
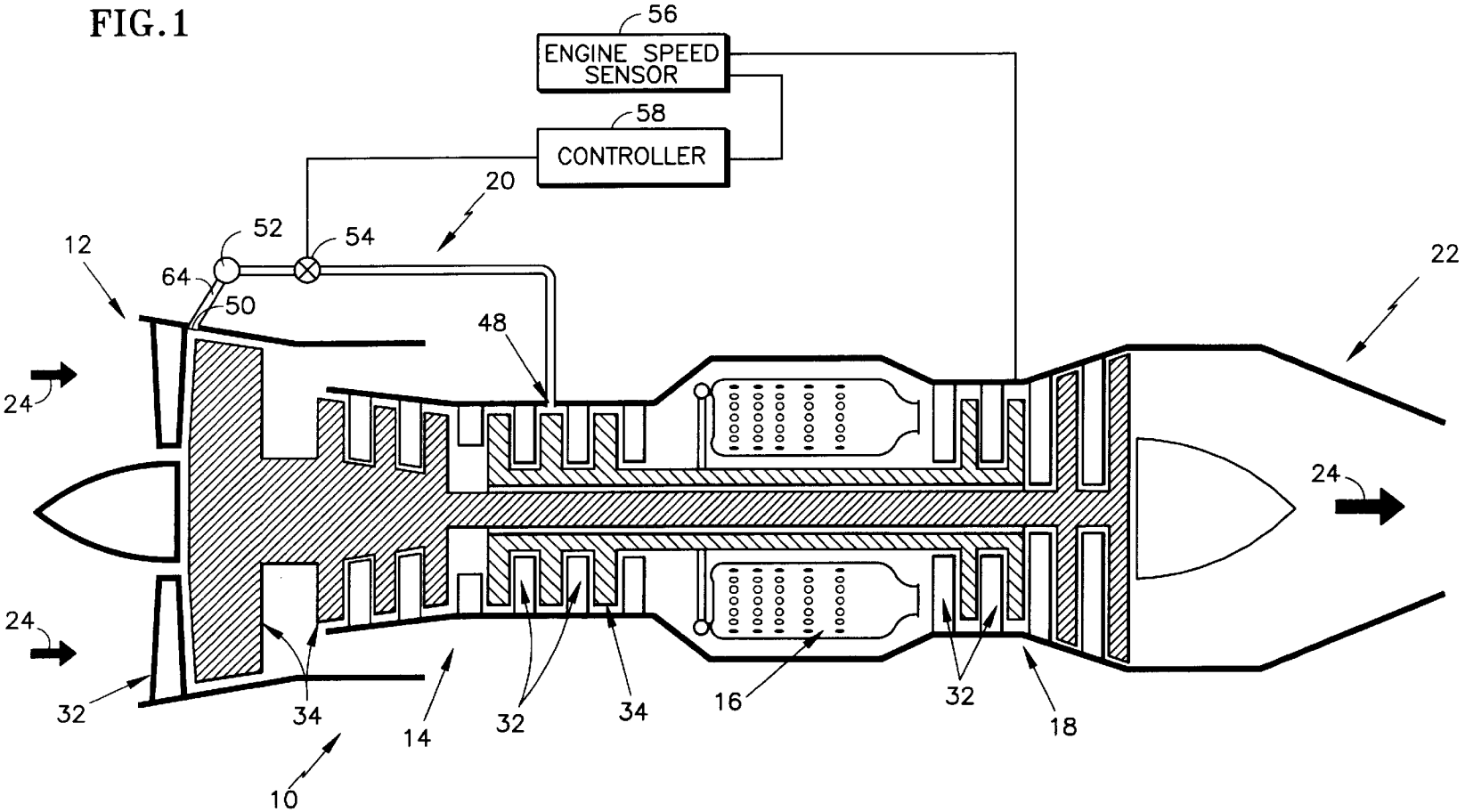
FIG. 1 is a diagrammatic view of a gas turbine engine.
Figure 2:
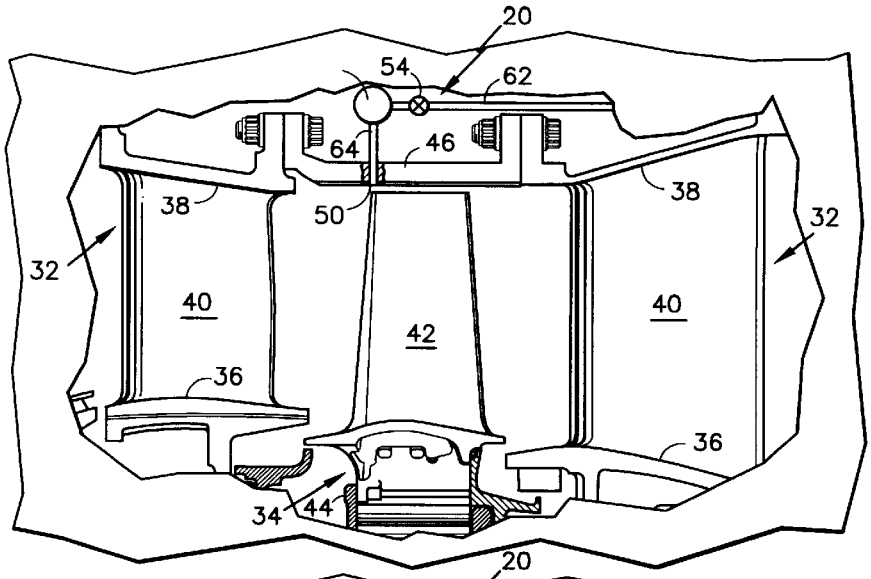
FIG. 2 is a diagrammatic view of a stator vane stage and a rotor stage including a first embodiment of the present invention apparatus for controlling vibrations in a rotor stage.
Figure 3:
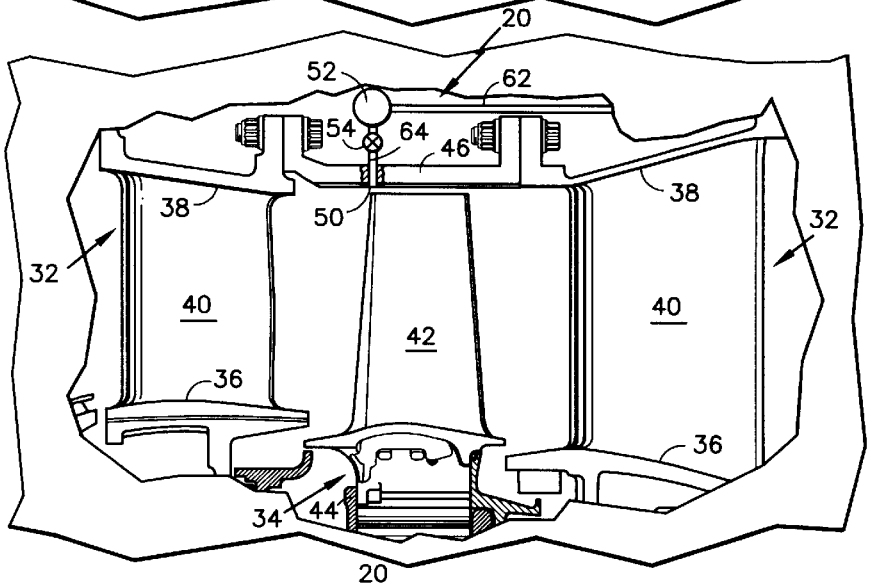
FIG. 3 is a diagrammatic view of a stator vane stage and a rotor stage including a second embodiment of the present invention apparatus for controlling vibrations in a rotor stage.
Figure 4:
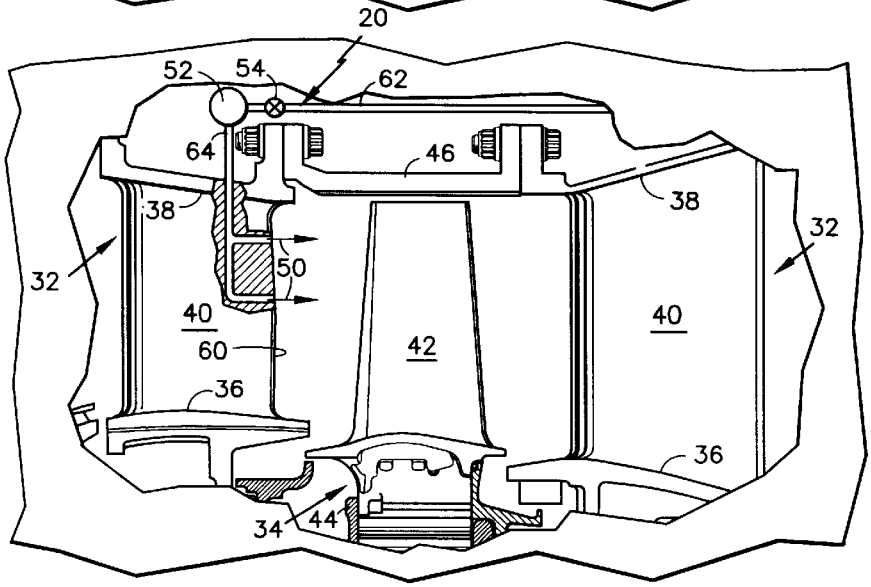
FIG. 4 is a diagrammatic view of a stator vane stage and a rotor stage including a third embodiment of the present invention apparatus for controlling vibrations in a rotor stage.

Referring to FIG. 1, a gas turbine engine 10 includes a fan 12, a compressor 14, a combustor 16, a turbine 18, apparatus 20 for controlling vibrations in a rotor stage, and a nozzle 22. Air 24 (also referred to as "core gas flow") drawn into the engine 10 via the fan 12 follows a path substantially parallel to the axis of the engine 10 through the compressor 14, combustor 16, and turbine 18 in that order. The fan 12, compressor 14, and turbine 18, each include a plurality of stator vane stages 32 and rotor stages 34. As can be seen in FIGS. 2–4, most stator vane stages 32 include an inner 36 and an outer 38 radial platform and a plurality of stator vanes 40 extending radially therebetween. Each rotor stage 34 includes a plurality of rotor blades 42 extending out from a disk 44. The rotor blades 42 may be attached to the disk 44 via conventional attachment methods (e.g., fir tree or dovetail root—not shown) or may be integrally attached as a part of an integrally bladed rotor (IBR). Liners 46, disposed radially outside of the rotor stages 34, may include blade outer air seals (not shown), or the like, for sealing at the tip of the rotor blades 42.

In the preferred embodiment, the apparatus 20 for controlling vibrations in a rotor stage 34 includes a source 48 of high-pressure gas (see FIG. 1), a plurality of ports 50 for dispensing high-pressure gas upstream of the rotor stage 34, a manifold 52 connecting the ports 50 to the source 48 of high-pressure gas, a selectively operable valve 54 disposed between the high-pressure gas source 48 and the ports 50, an engine speed sensor 56, and a programmable controller 58 (see FIG. 1 for sensor 56 and controller 58). The high-pressure gas source 48 is preferably the compressor 14, although the exact tap position within the compressor 14 will depend upon the pressure requirements of the application at hand; i.e., gas at a higher relative pressure can be tapped from later compressor stages and gas at a lower relative pressure can be tapped from earlier compressor stages. Each port 50 is an orifice having a cross-sectional area chosen to produce a particular velocity of gas exiting the port 50, for a given pressure of gas. In an alternative embodiment, each port 50 has a selectively adjustable cross-sectional area. In a first embodiment (FIGS. 2 and 3), the ports 50 are disposed in the liner 46, between the stator vane stage 32 and the rotor stage 34, aligned with the stator vanes 40. In a second embodiment (FIG. 4), the ports 50 are disposed in the trailing edge 60 of the stator vanes 40. Within the stator vanes 40, the ports 50 are preferably positioned adjacent the outer radial platform 38, but additional ports 50 may be disposed within or adjacent the trailing edge 60 between the inner 36 and outer 38 radial platforms. In fact, a port 50 may be disposed within the trailing edge 60 at a position radially aligned with a particular region of the rotor blades 42 subject to a particular mode of vibration. One or more first high-pressure lines 62 connect the manifold 52 to the compressor stage 34. A plurality of second high-pressure lines 64 connect the manifold 52 to the ports 50. In one embodiment (FIG. 2), each first high-pressure line 62 includes a selectively operable valve 54. In another embodiment (FIG. 3), each second high-pressure line 64 includes a selectively operable valve 54. The engine speed sensor 56 (shown diagrammatically in FIG. 1) is a commercially available unit, such as an electromechanical tachometer. The programmable controller 58 (shown diagrammatically in FIG. 1) is a commercially available unit that includes a central processing unit, a memory storage device, an input device, and an output device.

II. Operation

Referring to FIG. 1, in the operation of the engine 10, core gas flow 24 passes through the fan 12, compressor 14, combustor 16, and turbine 18 before exiting via the nozzle 22. The fan 12 and compressor 14 sections add energy to the core gas flow 24 by increasing the pressure of the flow 24. The combustor 16 adds additional energy to the core gas flow 24 by injecting fuel and combusting the mixture. The turbine 18 extracts energy from the core gas flow 24 to power the fan 12 and compressor 14.

Figure 5:
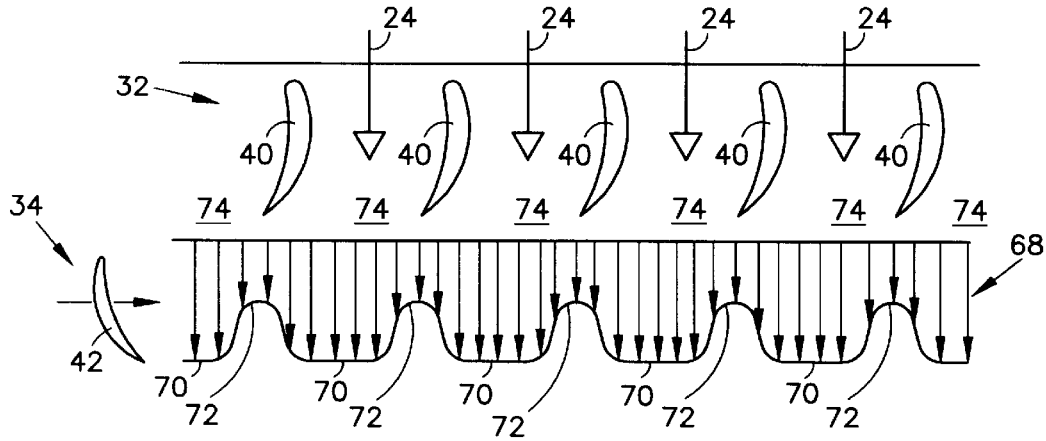
FIG. 5 is a diagrammatic view of a stator vane stage and a rotor stage, including a velocity profile taken downstream of the stator vane stage.
Figure 6:
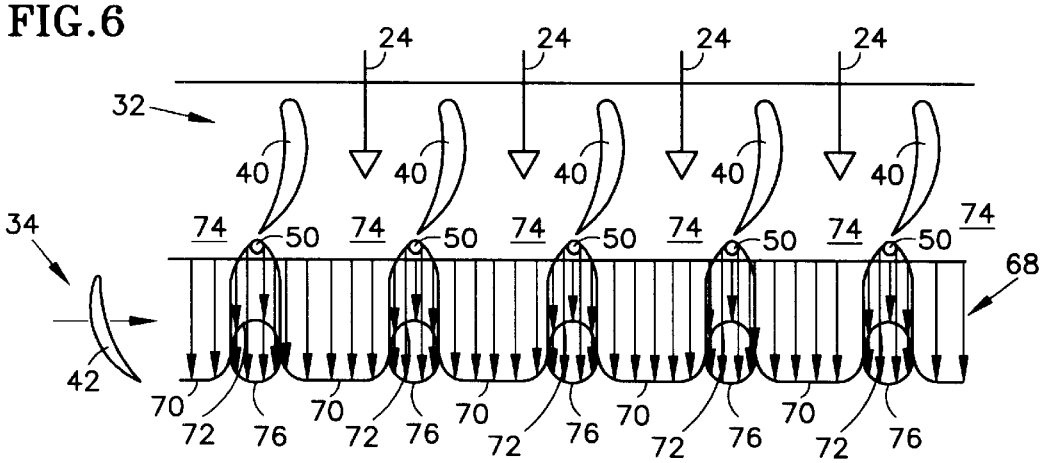
FIG. 6 is a diagrammatic view of a stator vane stage and a rotor stage, including a velocity profile taken downstream of the stator vane stage. The velocity profile shown in FIG. 6 shows the addition of high-pressure gas from the present invention apparatus for controlling vibrations in a rotor stage.
Figure 7:
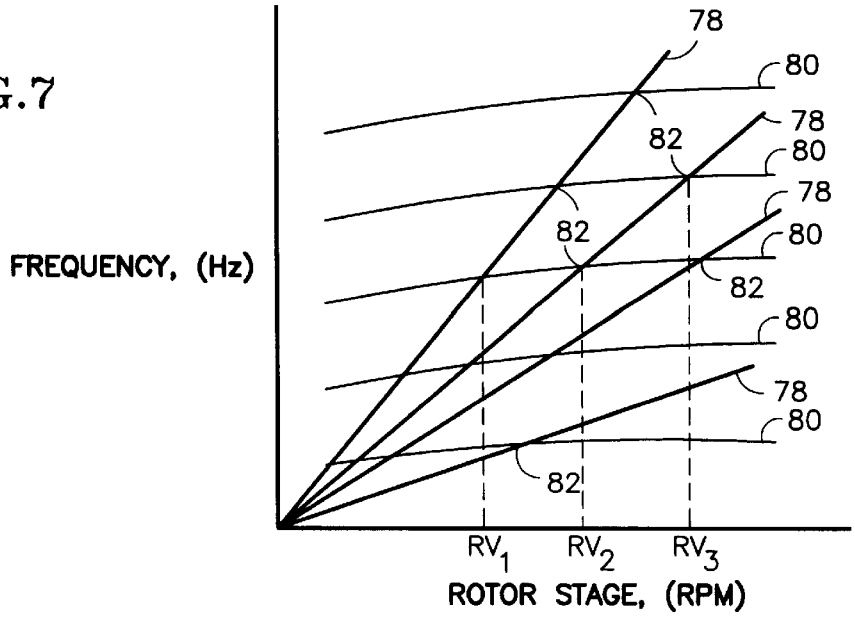
FIG. 7 is a graphic illustration of the relationship between a periodic excitation force frequency and the natural frequencies of a rotor stage versus the rotational velocity of the rotor stage.
Figure 8:
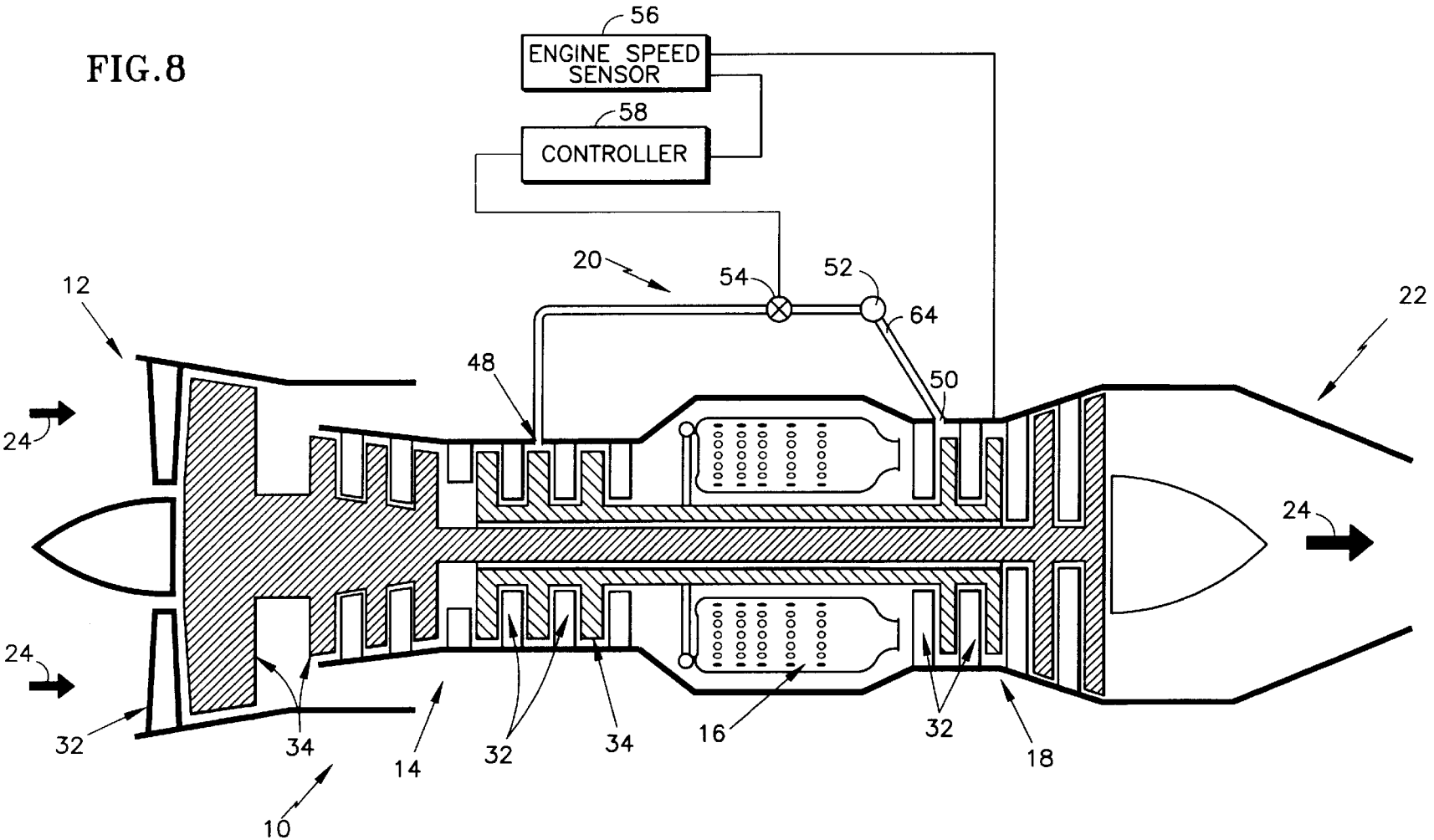
FIG. 8 is a diagrammatic view of a gas turbine engine showing a embodiment of the present invention.

Referring to FIGS. 5 and 6, velocity profiles 68 reflecting core gas flow 24 passing through a stator vane stage 32 and into the path of a rotor stage 34 in the fan 12, compressor 14, or turbine 18, typically include a plurality of high 70 and low 72 velocity regions, circumferentially distributed. The low velocity regions 72 are disposed downstream of, and aligned with, the stator vanes 40. The high velocity regions 70 are disposed downstream of, and aligned with, the passages 74 between the stator vanes 40. The rotor blades 42 passing through the high 70 and low 72 velocity regions experience the periodic excitation force described earlier as "ΔF". The periodic excitation force is particularly problematic when it has a frequency that coincides with a natural frequency of the rotor stage 34 (including any attributable to the rotor blades 42); i.e., a resonant condition. Resonance between an excitation force and a rotor stage 34 natural frequency can amplify vibrations and attendant stress levels within the rotor stage 34. FIG. 7 graphically illustrates the relationship between an excitation force frequency 78, a natural frequency 80 of a rotor stage, and the rotational velocity of the rotor stage. The intersections 82 shown between the excitation force frequencies 78 and the natural frequencies 80 of the rotor stage, at particular rotor stage rotational velocities ($RV_1$, $RV_2$, $RV_3$), are where the resonant responses are likely to occur.

Referring to FIG. 1, to avoid or minimize an undesirable resonance response, the controller 58 is programmed with empirically developed data (i.e., like that shown in FIG. 7) that correlates rotor stage rotational velocity (and therefore the frequency of the excitation force) with the natural frequencies of the rotor stage 34. The controller 58 receives a signal representing rotor stage 34 rotational velocity from the engine speed sensor 56. At critical junctions where excitation force frequency equals, or substantially equals, a rotor stage 34 natural frequency, the controller 58 sends a signal to the selectively operable valve(s) 54 to open. The open valve(s) 54 permits high-pressure gas bled off the compressor 14 to pass between the compressor 14 and the ports 50 disposed upstream of the rotor stage 34. If the selectively operable valve(s) 54 is disposed in the first high-pressure line(s) 62 (see FIGS. 2 and 4), opening the valve(s) 54 permits high-pressure core gas from the compressor 14 to pass into the manifold 52 where it is distributed to each of the ports 50. If, on the other hand, the selectively operable valve(s) 54 is disposed in the second high-pressure lines 64 (see FIG. 3), opening the valve(s) 54 permits high-pressure core gas from the compressor 14 already distributed in the manifold 52 to pass into each of the ports 50. In either case, the high-pressure gas 76 exiting the ports 50 (shown graphically in FIG. 6) passes into the low velocity region 72 downstream of each stator vane 40. The high-pressure gas 76 entering the low velocity regions 72 increases the average velocity of the core gas flow 24 within the low velocity regions 72 to substantially that of the adjacent high velocity regions 70. Rotor blades 42 rotating past the stator vanes 40 consequently experience a substantially diminished "ΔF" periodic excitation force, or no periodic excitation force at all. The vibration and stress caused by the periodic excitation force is consequently substantially diminished or eliminated. When the engine speed sensor 56 indicates to the controller 58 that the rotational velocity of the rotor stage 34, and therefore the frequency of the excitation force, has changed from the critical junction, the controller 58 signals the selectively operable valve(s) 54 to close and stop the flow of high-pressure gas 76 through the ports 50.

Depending on the application, it may not be necessary to operate the apparatus 20 for controlling vibrations at every instance where the natural frequency of the rotor stage 34 and the frequency of the excitation force coincide. This is particularly true where the frequencies coincide at lower rotor rotational velocities where the excitation forces are relatively low in magnitude and the resonance response is tolerable. In addition, it is also possible to maintain a flow of high-pressure gas flow through the ports 50 at all times, thereby eliminating the need for the selectively operable valve means 54. Depending upon the application, a constant flow through the ports may be feasible, particularly if the-cross-sectional area of each port is selectively variable.

Although this invention has been shown and described with respect to the detailed embodiments thereof, it will be understood by those skilled in the art that various changes in form and detail thereof may be made without departing from the spirit and the scope of the invention. As an example, the best mode discloses the source of high-pressure gas as the compressor. Other sources of high-pressure gas may be used alternatively.

We claim:

1. An apparatus for controlling vibrations in a rotor stage of a gas turbine engine, which rotor stage rotates around an axis through core gas flow traveling substantially parallel to said axis, comprising:

a source of high-pressure gas, said high-pressure gas at a pressure higher than the core gas flow local to said rotor stage;

wherein the core gas flow includes circumferentially distributed first regions and second regions, said first regions containing core gas flow traveling at a first velocity and said second regions containing core gas flow traveling at a second velocity, wherein said first velocity is substantially higher than said second velocity;

a plurality of ports, positioned upstream of and adjacent the rotor stage, aligned with said second regions, and connected to said source of high-pressure gas;

wherein high-pressure gas exiting said ports enters said second regions and substantially decreases the difference in core gas flow velocity between said first and second regions.

2. An apparatus according to claim 1, further comprising:

a selectively operable valve means, positioned in line between said source of high-pressure gas and said ports, wherein said selectively operable valve means can be selectively opened to permit passage of high-pressure gas from said source to said ports.

3. An apparatus according to claim 1, further comprising:

a manifold;

at least one first line, connecting said manifold to said source of high-pressure gas; and a plurality of second lines, connecting said plurality of ports to said manifold; and wherein said manifold distributes said high-pressure gas to said ports.

4. An apparatus according to claim 3, further comprising:

a selectively operable valve means, disposed in each said first line, wherein said selectively operable valve means can be selectively opened to permit passage of high-pressure gas from said source to said ports.

5. An apparatus according to claim 4, further comprising:

a programmable controller;

a velocity sensor for sensing the rotational velocity of the rotor stage;

wherein said velocity sensor sends a signal to said controller indicating the rotational velocity of the rotor stage, and said controller causes said selectively operable valve means to open and close at certain rotor stage rotational velocities.

6. An apparatus according to claim 5, wherein said source of high-pressure gas is a compressor within the gas turbine engine.

7. A turbine for a gas turbine engine, comprising:

a stator vane stage, including an inner radial platform and an outer radial platform, and a plurality of circumferentially distributed stator vanes extending between;

a rotor stage, positioned downstream of and adjacent said stator vane stage, said rotor stage including a plurality of rotor blades extending radially outward from a disk;

a liner, positioned radially outside of said rotor stage;

means for controlling vibrations in said rotor stage, said means including a plurality of ports, disposed in said liner between said stator vane stage and said rotor stage, and aligned with said stator vanes;

wherein said ports are connected to a high-pressure gas source, selectively providing gas at a pressure substantially higher than the pressure of core gas flow passing through said rotor stage; and wherein said high-pressure gas exits said ports and acts on said rotor stage.

8. A turbine according to claim 7, further comprising:

a selectively operable valve means, positioned in line between said high-pressure gas source and said ports, wherein said selectively operable valve means can be selectively opened to permit passage of high-pressure gas from said source to said ports.

9. A turbine according to claim 8, further comprising:

a manifold;

at least one first line, connecting said manifold to said source of high-pressure gas; and a plurality of second lines, connecting said plurality of ports to said manifold; and wherein said manifold distributes said high-pressure gas to said ports.

10. A turbine according to claim 9, further comprising:

a selectively operable valve means, disposed in each said first line, wherein said selectively operable valve means can be selectively opened to permit passage of high-pressure gas from said source to said ports.

11. A turbine according to claim 10, further comprising:

a programmable controller;

a velocity sensor for sensing the rotational velocity of the rotor stage;

wherein said velocity sensor sends a signal to said controller indicating the rotational velocity of the rotor stage, and said controller causes said selectively operable valve means to open and close at certain rotor stage rotational velocities.

12. A gas turbine engine, comprising:

a fan;

a compressor;

a combustor;

a turbine;

wherein said fan, compressor, combustor, and turbine are axially aligned and core gas flow entering said fan passes through said compressor, combustor, and said turbine; and wherein at least one of said fan, compressor, or said turbine includes:

a stator vane stage, including an inner radial platform and an outer radial platform, and a plurality of stator vanes circumferentially distributed therebetween, a rotor stage, positioned downstream of, and adjacent, said stator vane stage, said rotor stage including a plurality of rotor blades extending radially outward from said disk; and a liner, radially outside of said rotor stage;

means for controlling vibrations in said rotor stage, said means including a plurality of ports disposed in said liner between said stator vane stage and said rotor stage, said ports aligned with said stator vanes;

wherein said ports are connected to a high-pressure gas source, selectively providing gas at a pressure substantially higher than the pressure of the core gas flow passing through the rotor stage; and wherein said high-pressure gas exits said ports and acts on said rotor stage.

13. A gas turbine engine according to claim 12, further comprising:

a selectively operable valve means, positioned in line between said source of high-pressure gas and said ports, wherein said selectively operable valve means can be selectively opened to permit passage of high-pressure gas from said source to said ports.

14. A gas turbine engine according to claim 13, further comprising:

a manifold;

at least one first line, connecting said manifold to said source of high-pressure gas; and a plurality of second lines, connecting said plurality of ports to said manifold; and wherein said manifold distributes said high-pressure gas to said ports.

15. A gas turbine engine according to claim 14, further comprising:

a selectively operable valve means, disposed in each said first line, wherein said selectively operable valve means can be selectively opened to permit passage of high-pressure gas from said source to said ports.

16. A gas turbine engine according to claim 15, further comprising:

a programmable controller;

a velocity sensor for sensing the rotational velocity of the rotor stage;

wherein said velocity sensor sends a signal to said controller indicating the rotational velocity of the rotor stage, and said controller causes said selectively operable valve means to open and close at certain rotor stage rotational velocities.

17. A gas turbine engine according to claim 16, wherein said source of high-pressure gas is a compressor within the gas turbine engine.

* * * * *